US006010414A

United States Patent [19]

Snow

[11] Patent Number: 6,010,414

[45] Date of Patent: Jan. 4, 2000

[54] RANDOM BOUNCE REACTION TRAINING DEVICE

[75] Inventor: Murray Charles Snow, Gig Harbor, Wash.

[73] Assignee: Murray Charles Snow, Gig Harbor, Wash.

[21] Appl. No.: 09/042,114

[22] Filed: Mar. 13, 1998

[51] Int. Cl.[7] ..... A63B 69/00

[52] U.S. Cl. ..... 473/422; 473/434; 273/342

[58] Field of Search ..... 473/218, 272, 473/270, 271, 434, 422, 438, 446, 451, 462; 428/99, 53, 143; 273/342

[56] References Cited

U.S. PATENT DOCUMENTS

| | | | |
|---|---|---|---|
| 3,001,790 | 9/1961 | Pratt . | |
| 3,088,735 | 5/1963 | Clark . | |
| 3,697,068 | 10/1972 | McDougall . | |
| 3,837,648 | 9/1974 | Breslow . | |
| 4,027,875 | 6/1977 | Hurley . | |
| 4,068,339 | 1/1978 | Maruyama | 15/215 |
| 4,237,635 | 12/1980 | Paraghamian . | |
| 4,262,048 | 4/1981 | Mitchell | 428/99 |
| 4,358,275 | 11/1982 | Paraghamian . | |
| 4,387,896 | 6/1983 | O'Brien | 473/218 |
| 4,647,046 | 3/1987 | Hurt . | |
| 4,702,475 | 10/1987 | Elston et al. . | |
| 4,879,151 | 11/1989 | Ellingson | 428/53 |
| 5,204,159 | 4/1993 | Tan | 428/143 |
| 5,207,432 | 5/1993 | Miller . | |
| 5,263,863 | 11/1993 | Stefani | 473/272 |
| 5,529,016 | 6/1996 | Lonsway . | |
| 5,698,276 | 12/1997 | Mirabitur | 428/31 |

FOREIGN PATENT DOCUMENTS 2 202 751 10/1988 United Kingdom .

*Primary Examiner*—Sebastiano Passaniti
*Attorney, Agent, or Firm*—Seed and Berry LLP

[57] ABSTRACT

The device is a one piece molded unity of resilient material consisting of a base (10) having upper and lower surfaces. The lower surface is generally flat. The upper surface is made non-planer by the presence of numerous irregularities, such as projections (12) (16) (18), formed as part of the unit during the fabrication process. A through hole (14) is provided for carrying purposes.

13 Claims, 6 Drawing Sheets

RANDOM BOUNCE REACTION TRAINING DEVICE

FIELD OF INVENTION

This invention relates to realistic reaction training of athletes participating in sports involving moving objects such as balls and pucks.

DESCRIPTION OF PRIOR ART

Various sports including baseball, ice hockey, football and volleyball require participants to react to fast moving objects. During play these objects can be deflected resulting in an unpredictable path of motion. The athletes involved must react to such random movement in order to effectively perform. Those athletes with the quickest reactions will perform more efficiently.

Reaction training in the past has consisted of using, mechanical and electrical devices and by taking advantage of erratic object movement that occasionally occurs during regular practice sessions.

U.S. Pat. No. 4,027,875 to Hurley (1977) is an electrically operated device that uses a timer and a plunger system for activation/deactivation purposes. A system of support stands secures the components in place. U.S. Pat. No. 4,358,275 to Paraghamian and Long (1982) discloses an electronic apparatus utilizing a word generator, programmable read only memory and other electrical components. U.S. Pat. No. 4,702,475 to Elsten, Faret, Gazzo (1987) discloses a portable reaction training device utilizing an array of lights, a programmable control system and an audible feedback system.

The devices described above are all complex electro/mechanical systems that require special operating skills in order to provide effective training. Due to their design and fabrication requirements an outside source of electrical power is necessary for their operation. Thus an additional parameter must be met prior to using these devices. Being complex systems they are prone to breakdown. The cost of procuring such systems combined with repair and maintenance expenses incurred during their lifetime renders these devices impractical for purchase by the general public.

U.S. Pat. No. 4,237,635 to Paraghamian and Kelly (1980) consists of a system of belts, indicia and a drive system combined with a selectively operable control mechanism. This is a highly complex and cumbersome system requiring skilled operation, repair and maintenance.

All of the above systems suffer from the following disadvantages:

(a) They are complex in design and fabrication making them susceptible to breakdown.

(b) They require regular maintenance and repair.

(c) They are costly to procure.

(d) They require various non-athletic skills for proper functioning.

(e) The reliance on an external power source severely limits their use in unconventional settings.

(f) These training systems are not directly related to any particular sport.

(g) They are bulky and difficult to transport.

OBJECTS AND ADVANTAGES

Several objects and advantages of the present invention are:

(a) To provide a device that guarantees a high degree of reaction training.

(b) To provide a device that requires little or no maintenance.

(c) To provide a device that is simple to use.

(d) To provide a device that accurately provides real sport reaction training.

(e) To provide a device that is easy to transport and store.

(f) To provide a device that can be used indoors and outdoors.

(g) To provide a device that does not require an external power source.

(h) To provide a device that is inexpensive.

Further objects and advantages are to provide a device that can be fabricated in a wide variety of shapes, sizes and colors, that can be used to provide entertainment for people of all ages, that will improve confidence at all skill levels. Still further objects and advantages will become apparent from a consideration of the ensuing description and drawings.

DRAWING FIGS.

Figure 5:
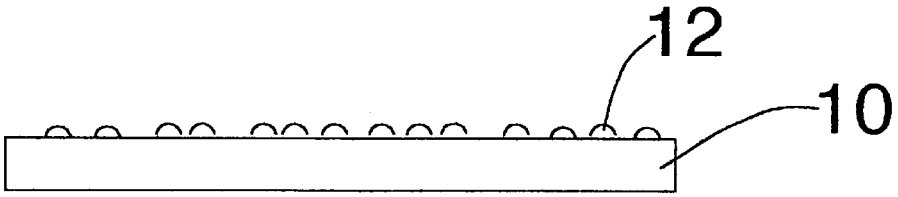

FIGS. 5 (end view) and 6 (top view) show size, shape and asymmetrical projection placement.

Figure 7:
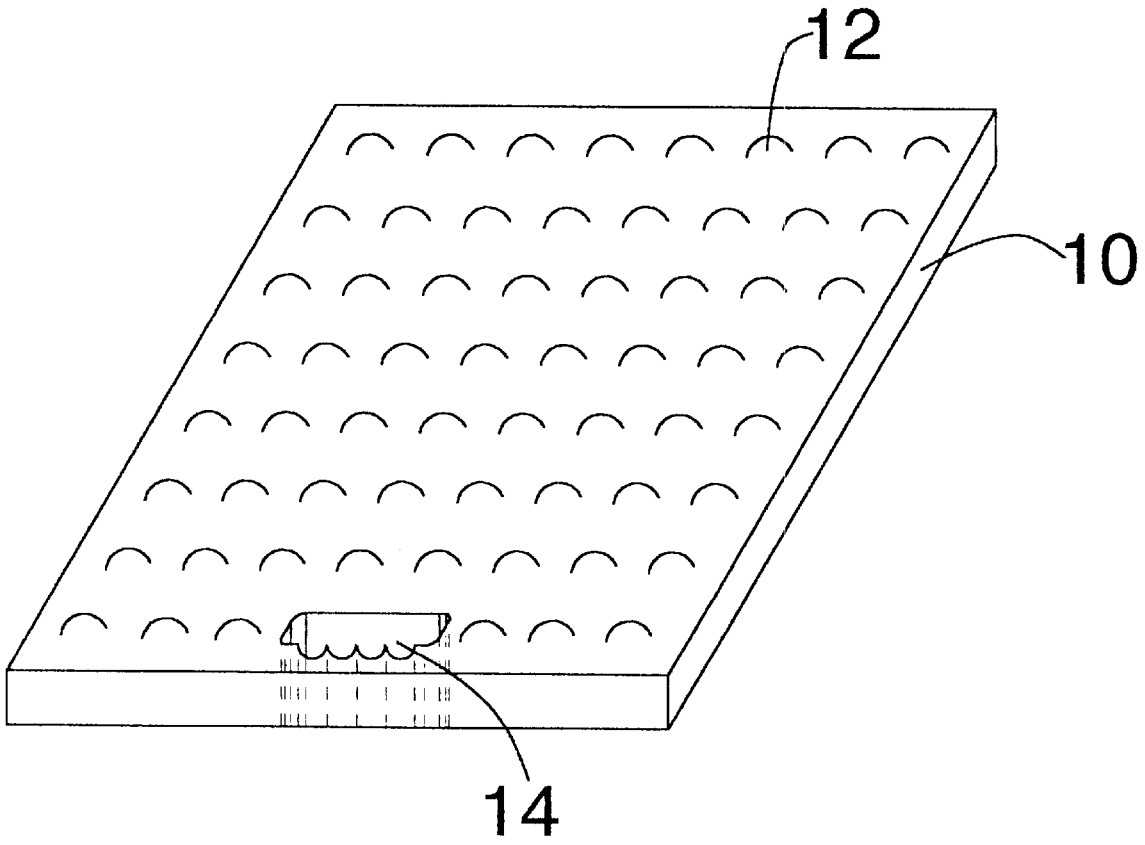
Figure 9:
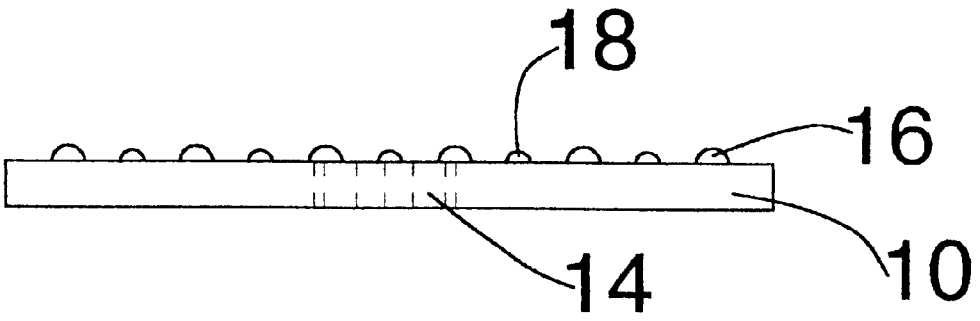

FIG. 7 shows the device with a built-in hand hold for carrying purposes.

Figure 8:
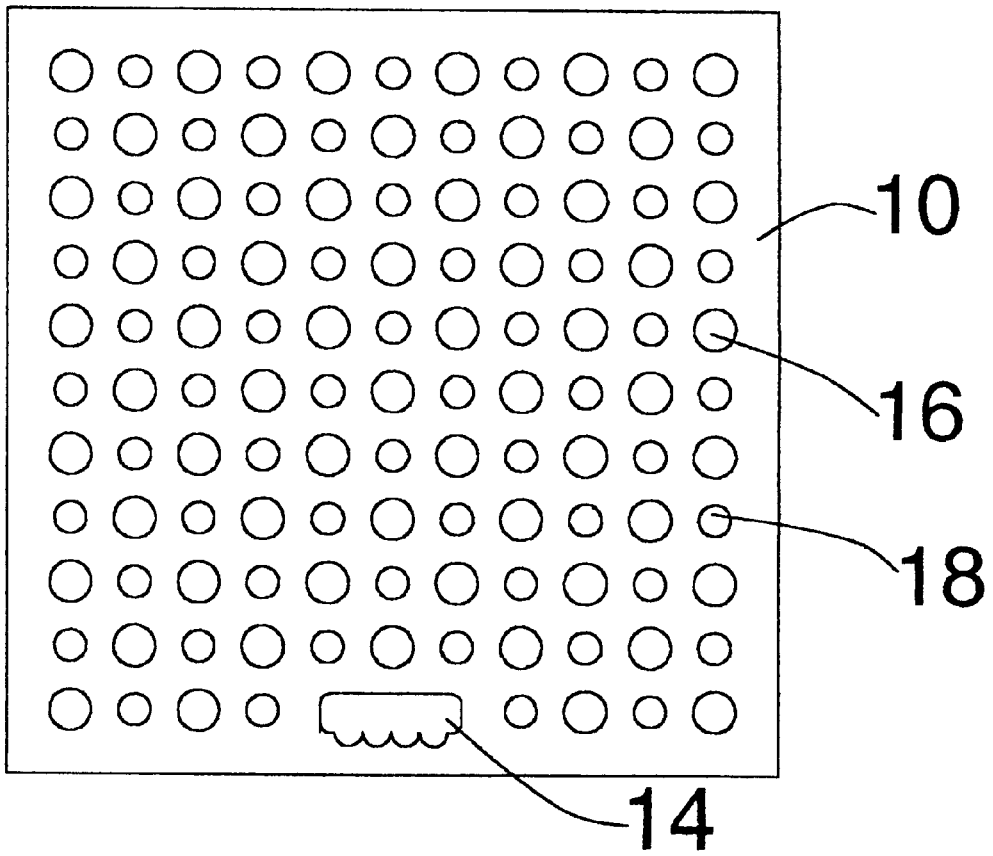

FIGS. 8 (top view) and 9 (end view) shows the device with a hand hold and projections of two distinct sizes placed in a symmetrical pattern on the upper surface.

Numerals in Drawings

10 base of device
12 projection on upper surface
14 through hole
16 large projection on upper surface
18 small projection on upper surface

SUMMARY

A training device comprised of a flat body of material having a flat lower surface and an irregular upper surface.

Description—FIGS. 1 to 9

Figure 2:
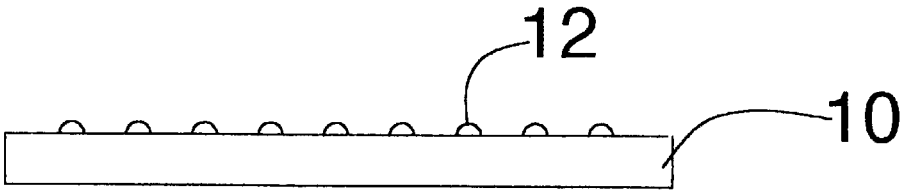
FIG. 2 is an end view of the device showing all projections being of equal size and shape.
Figure 1:
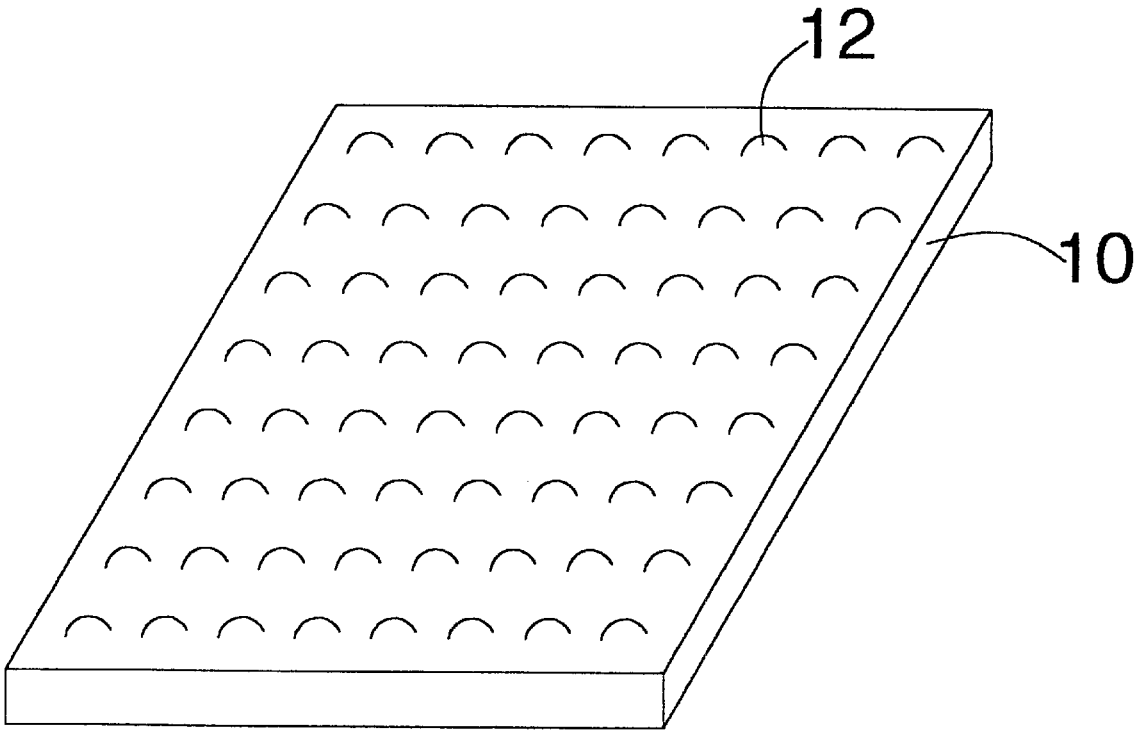
FIG. 1 shows the device with a symmetrical pattern of projections located on the upper surface.
Figure 3:
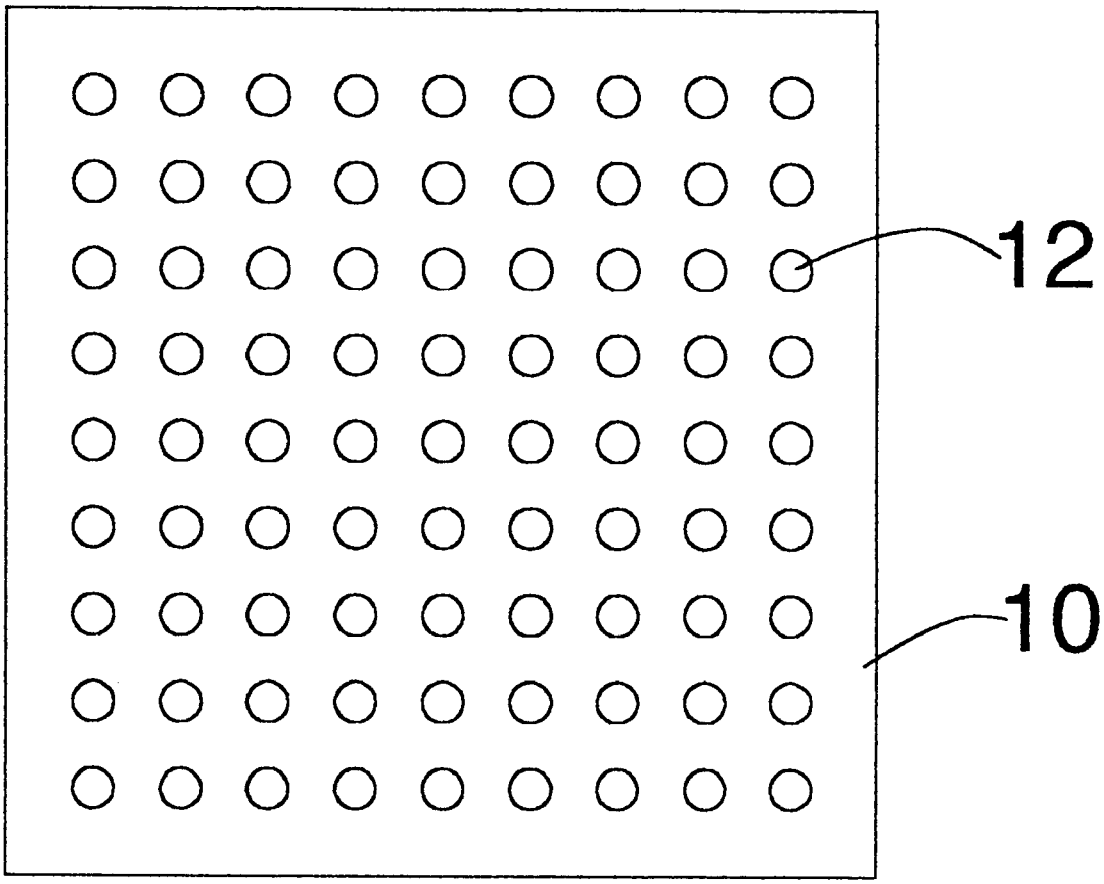
FIG. 3 is a top view showing the symmetrical placement of the projections.

A typical embodiment of the device is shown in FIGS. 1, 2 & 3. The device is a one piece molded unit consisting of a resilient material capable of absorbing numerous high speed impacts without being damaged. The base 10 provides overall stiffness and support for the projections 12 located on the upper surface of the device. In the preferred embodiment the device is fabricated using a resilient somewhat flexible material such as Conathane TU-961 which is a polyurethane casting system manufactured by Conap, Inc. of Olean, N.Y. The device is approximately 3 feet square with a base 10 having a thickness of about ⅜" and projections 12 having a diameter of about ¾" and a height of about ¼". The projections 12 are spaced approximately 2" apart in a symmetrical pattern on the upper surface.

Figure 4:
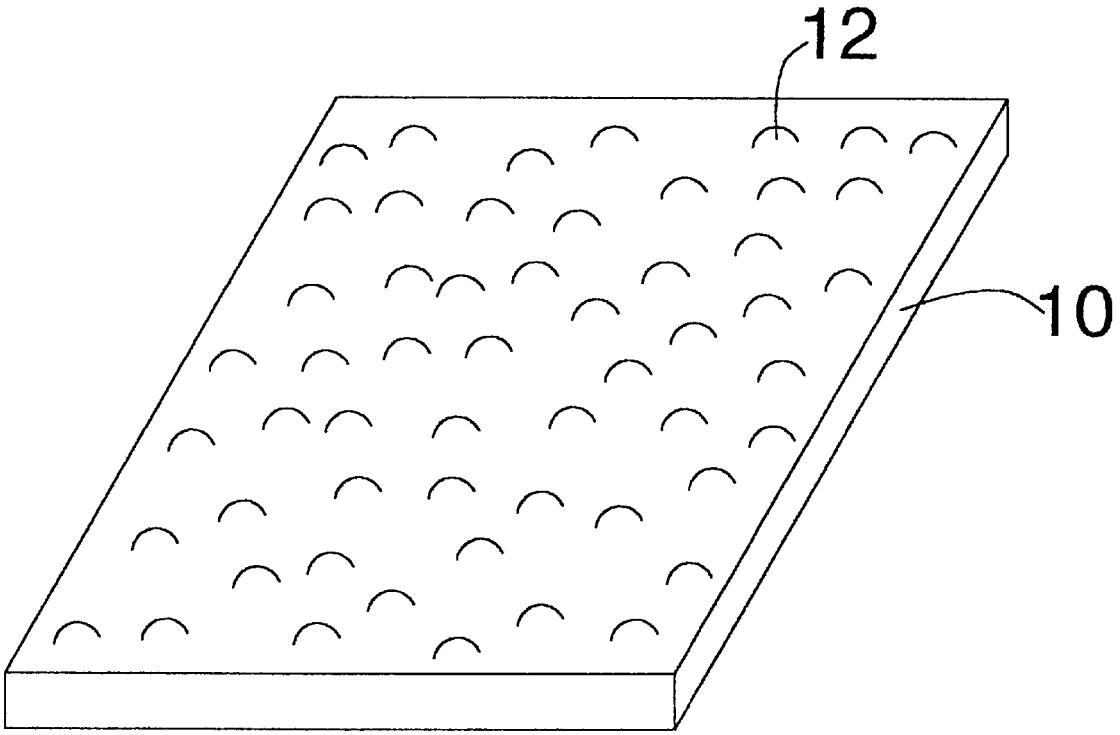
FIG. 4 shows an asymmetrical pattern of projections located on the upper surface.
Figure 6:
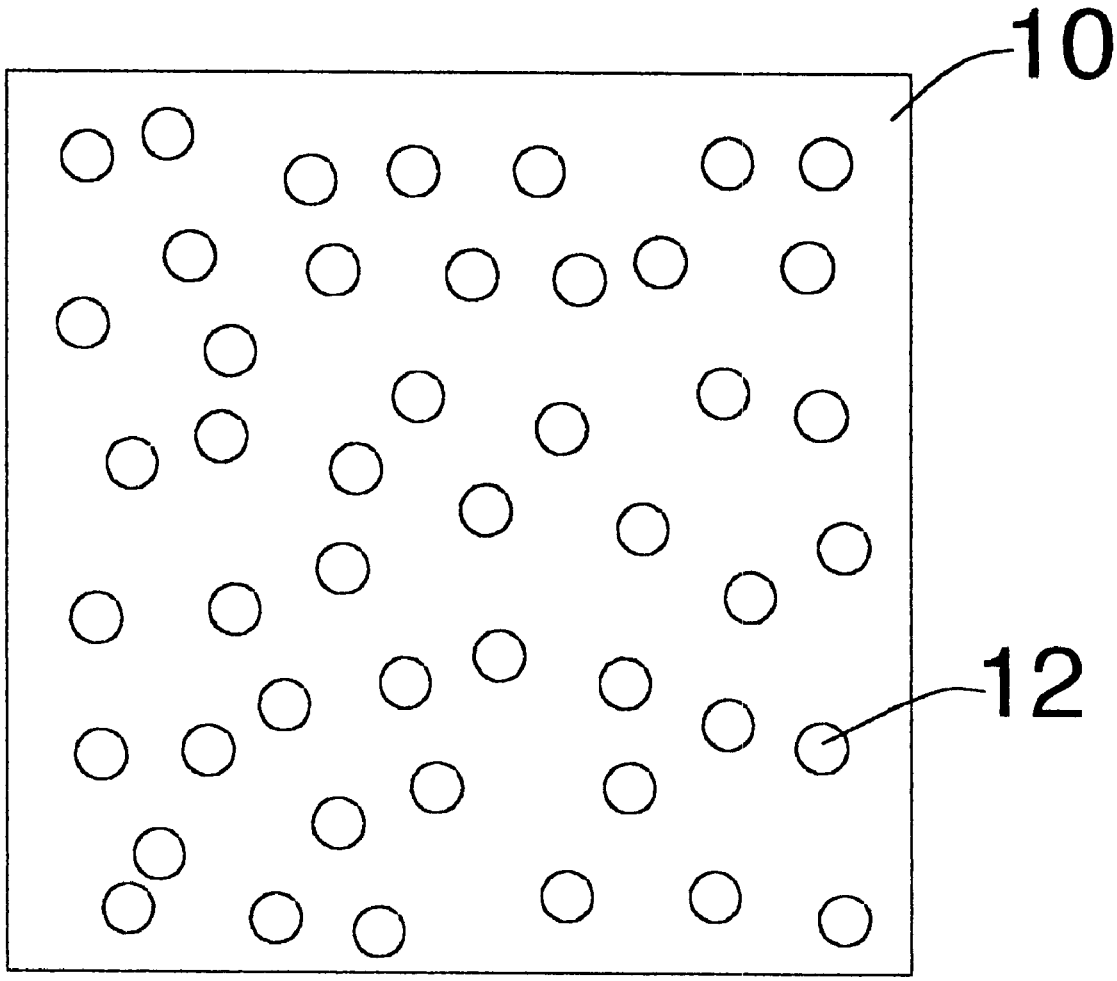

FIGS. 4, 5, & 6 show an embodiment where the pattern of placement for the projections is asymmetrical. An additional embodiment is shown in FIG. 7. This embodiment is similar to that shown in FIG. 1 with the addition of a built-in through hole 14 for ease of carrying.

FIGS. 8 (top view) and 9 (end view) show an embodiment where the projections are large 16 and small 18.

From the description above a number of advantages of this invention become evident.

(a) It is simple in design.

(b) The device is easy to hand carry.

(c) The simple one piece design essentially eliminates the chance of structural failure.

(d) It is readily adaptable to both indoor and outdoor use.

(e) It is a self contained unit.

(f) Use of the device mimics actual athletic activity.

Operation—FIGS. 1, 3, 4, 6, 8, 9

With the device laying on the ground/floor an individual, known as the receiver, will stand facing the device. An object such as a baseball is then propelled toward the individual in such a manner as to strike the upper surface of the device. The resulting bounce of the object is dependent upon where on the upper surface the object impacts. When impact occurs between projections 12 indicated in FIGS. 1, 3, 4, 6, or projections 16 and 18 indicated in FIG. 8 the object will bounce in a predictable manner. Contact with any of the above mentioned projections during impact, will cause the object to bounce in an unpredictable manner. The receiver must catch the object by reacting to its movement after it impacts the upper surface of the device.

Conclusion, Ramifications, and Scope

Accordingly, the reader will see that the random bounce device of this invention can be used as an effective training tool that is simple to set up, convenient to use and easily adaptable to a variety of training situations. Still further advantages of the device are that It is simple in design.

It requires the use of actual athletic movement for effective training.

It is a self contained unit.

It is easily transported and stored.

The specific aspects included in the above description are central to the preferred embodiments but should not limit the scope of the invention. The device can be fabricated in any desired shape, color and size. The lower surface can be fabricated in order to provide a non skid type gripping action for indoor or outdoor use. A system of integrally formed attachments located around the periphery would allow individual devices to be secured to one another providing a larger surface area for practice purposes.

The scope of this invention should be determined by analyzing both the attached claims and applicable legal equivalents and not solely by the examples provided above.

I claim:

1. A random bounce reaction device, comprising a substantially horizontal planar sheet having a substantially horizontal planar upper surface; and a plurality of substantially rigid projections distributed on and projecting from the substantially horizontal planar upper surface, the projections being sized to at least partially deflect a moving object from a normal bounce path when the moving object at least partially strikes at least one of the projections, the normal bounce path being a path the moving object would follow when striking the substantially horizontal planar upper surface without striking any projections, the projections being further sized to be substantially smaller than the moving object and at least some of the projections being spaced apart so that the moving object may be bounced on the substantially horizontal planar upper surface along the normal bounce path without striking any of the projections.

2. The device of claim 1 wherein said projections comprise polyurethane projections.

3. The device of claim 1 wherein said projections are non-uniformly distributed on the upper surface.

4. The device of claim 1 wherein said projections comprise hemispherical projections.

5. The device of claim 1 wherein said projections are integrally molded with the sheet.

6. The device of claim 1 wherein said projections comprise substantially uniformly shaped projections.

7. The device of claim 1 wherein said sheet includes a through hole located near a periphery of the sheet.

8. The device of claim 7 wherein said through hole defining a handle portion is sized to receive a portion of a hand there through.

9. A random bounce reaction training system, comprising a substantially horizontal planar sheet of material having a substantially horizontal planar upper surface;

a training object projectable toward the substantially horizontal planar upper surface and bounceable from the substantially horizontal planar upper surface; and a plurality of projections distributed on and projecting from the substantially horizontal planar upper surface, the projections being sized to at least partially deflect the training object from a normal bounce path when the training object at least partially strikes at least one of the projections, the normal bounce path being a path the training object would follow when striking the substantially horizontal planar upper surface without striking any projections, the projections being further sized to be substantially smaller than the training object and at least some of the projections being spaced apart so that the training object may be bounced on the substantially horizontal planar upper surface alone the normal bounce path without striking any of the projections.

10. The system of claim 9 wherein said training object comprises a ball.

11. The system of claim 9 wherein said projections comprise polyurethane projections irregularly distributed over the upper surface.

12. The system of claim 9 wherein the projections comprise irregularly shaped projections.

13. The system of claim 9 wherein said projections are integrally molded with the upper surface.

* * * * *

UNITED STATES PATENT AND TRADEMARK OFFICE

CERTIFICATE OF CORRECTION

PATENT NO. : 6,010,414
DATED : January 4, 2000
INVENTOR(S) : Murray Charles Snow It is certified that error appears in the above-identified patent and that said Letters Patent is hereby corrected as shown below:

On the cover page, item [57], delete "unity" and substitute therefor -- unit --.

Signed and Sealed this

Fifteenth Day of August, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO : 6,010,414
DATED : Jan. 4, 2000
INVENTOR(S) : Murray Charles Snow

It is certified that error appears in the above-identified patent and that said Letters Patent is hereby corrected as shown below:

Claim 9, column 4, line 48, "surface alone the normal" should read --surface along the normal--.

Signed and Sealed this

Seventeenth Day of October, 2000

*Attest:*

Q. TODD DICKINSON

*Attesting Officer*

*Director of Patents and Trademarks*